United States Patent [19]

Aulabaugh

[11] Patent Number: 5,065,965

[45] Date of Patent: Nov. 19, 1991

[54] TRASH BAG HOLDER

[76] Inventor: R. Michael Aulabaugh, 1510 Seagull Dr., S. Pasadena, Fla. 33707

[21] Appl. No.: 573,441

[22] Filed: Aug. 27, 1990

[51] Int. Cl.[5] ..... B65B 67/00

[52] U.S. Cl. ..... 248/99; 141/390

[58] Field of Search ..... 248/95, 97, 98, 99, 248/100; 220/404; 141/390

[56] References Cited

U.S. PATENT DOCUMENTS

| | | | |
|---|---|---|---|
| 4,037,778 | 7/1977 | Boyle | 248/99 X |
| 4,281,813 | 8/1981 | Garrity | 248/97 |
| 4,457,483 | 7/1984 | Gagne | 248/97 |
| 4,832,292 | 5/1989 | Beckham | 248/99 |
| 4,884,603 | 12/1989 | Simpson | 248/99 X |
| 4,890,652 | 1/1990 | Hoerner | 248/99 X |
| 4,940,200 | 7/1990 | Sawyer | 248/97 |

*Primary Examiner*—David L. Talbott

[57] ABSTRACT

The trash bag holder disclosed herein comprises a collapsible frame which is inserted preferably in its collapsed condition into the trash bag and is then opened to provide supports for the sides of the bag while trash is swept into the bag while it is laid horizontally on the ground. This holder has a flap at the front of the frame which facilitates the sweeping of trash into the bag. Where desired an additional support may be provided to hold the top side of the bag when it is laid on the ground. When the bag is filled, the frame is easily withdrawn from the bags.

2 Claims, 3 Drawing Sheets

TRASH BAG HOLDER

BACKGROUND OF THE INVENTION

1. Field of the Invention

This invention relates to a device for holding a trash bag open while trash is being swept into the bag. More specifically it relates to a collapsible device which may be inserted into the trash bag and then opened to provide bottom and side wall supports to keep the bag open. Still more specifically the device also provides a flap at the front thereof to facilitate the sweeping of leaves, grass clippings, etc., into the bag. Even more specifically this device may have a further support at the top thereof to further aid in keeping the bag open. Still more specifically the device is designed to be easily removed from the filled trash bag.

2. State of the Prior Art

Anyone who has raked leaves, grass clipping and other trash into a trash bag has experienced the difficulties of trying to keep the bag open while he is sweeping the trash into the bag. Various devices might have been tried to facilitate this task.

There are a number of patents describing devices for holding trash bags open in a vertical position while trash is deposited therein. These include U.S. Pat Nos.: 96,759; 447,686; 4,174,085; 4,304,378; 4,458,867; 4,623,111; and 4,869,447. However none of the devices described are designed to assist in the sweeping of trash into the bag while it is in a horizontal position.

There are two patents describing devices to assist in sweeping trash into a bag while the bag lays in a horizontal position. U.S. Pat. No. 3,638,888 shows a metal framework which has a base and substantially rectangular front and back loops. The bag is laid on the base and the open end of the bag is wrapped around the front loop to keep it open. There is no provision for supporting the sides of the bag.

U.S. Pat. No. 4,832,292 describes a molded apparatus to be fitted into the mouth of a trash bag designed to hold the mouth of the bag open and to facilitate sweeping trash into the bag. Here again there is no means shown for supporting the sides of the bag. This means that the front of the bag will be filled first and the bag most likely will have to be lifted to make the trash fall all the way into the bag.

OBJECTIVES

It is an object of this invention to provide a device to facilitate the sweeping of trash into a bag.

It is also an object of this invention to provide such a device which will hold the sides of the bag open to facilitate sweeping the trash well into the interior of the bag.

It is also an object of this invention to protect the bottom and sides of the bag from being pierced when hard, sharp objects are being swept into the bag.

It is still further an object of this invention to provide such a device which is easily removable from the bag when the bag is filled.

It is even further an object of this invention to provide such a device which is easily collapsible for storage.

It is still further an object of this invention to provide such a device which may also provide a fourth side to support the fourth or top wall of the bag when it lays horizontally for filling.

These and other objectives as described hereinafter are capable of being met by the device of this invention.

STATEMENT OF THE INVENTION

These objectives are met by the trash bag holder of this invention which in a preferred modification comprises a flat bottom panel and two side panels hinged to the bottom panel so that these two panels can either lay flat against the bottom panel or may be turned upward to an angle of 90° or more with the bottom panel. The bottom panel also has a lip or flap extending therefrom so that when the device is inserted, preferably in a collapsed condition, into a trash bag laying flat on the ground, this flap will facilitate the sweeping of trash into the bag. In addition to holding the bag open the various panels protect the bag from being pierced by hard, sharp objects in the trash being swept into the bag. When the bag is filled with trash the bag holder device may be easily withdrawn from the bag. The dimensions of the bottom and side panels are selected to accommodate the size of the bag being used.

In another modification a top panel may be added to give additional support to the trash bag while the trash is being introduced into the bag. This top panel is attached to one, or preferably to both of the side panels. When attached to both side panels, the side panels are each divided into two hinged segments, with hinges joining the side panels to both the top and bottom panels. In this latter modification the middles of the two side panels are pressed inwardly to collapse the device for storage and for insertion into the bag. When collapsed supporting device is fitted into the bag, the device may be opened by pressing the side panels outwardly to flatten them out and advantageously pushing them slightly outward to cause a bulge on each side of the bag. This bulging condition reduces the possibility of having the holder collapse before the bag is filled with trash. The insertion of the holder is advantageously performed while holding the bag in a vertical position and the holder expanded before the bag with holder inside is laid flat on the ground. In this modification the bottom panel has the flap extending therefrom as previously described to facilitate sweeping trash into the bag.

The respective panels are preferably made of plastic but may also be made of any other convenient material such as sheet metal. The hinges may be made of either plastic or metal and may be of various types to enable the desired function.

SPECIFIC EMBODIMENTS OF THE INVENTION

The description of the invention is facilitated by reference to the drawings.

Figure 1:
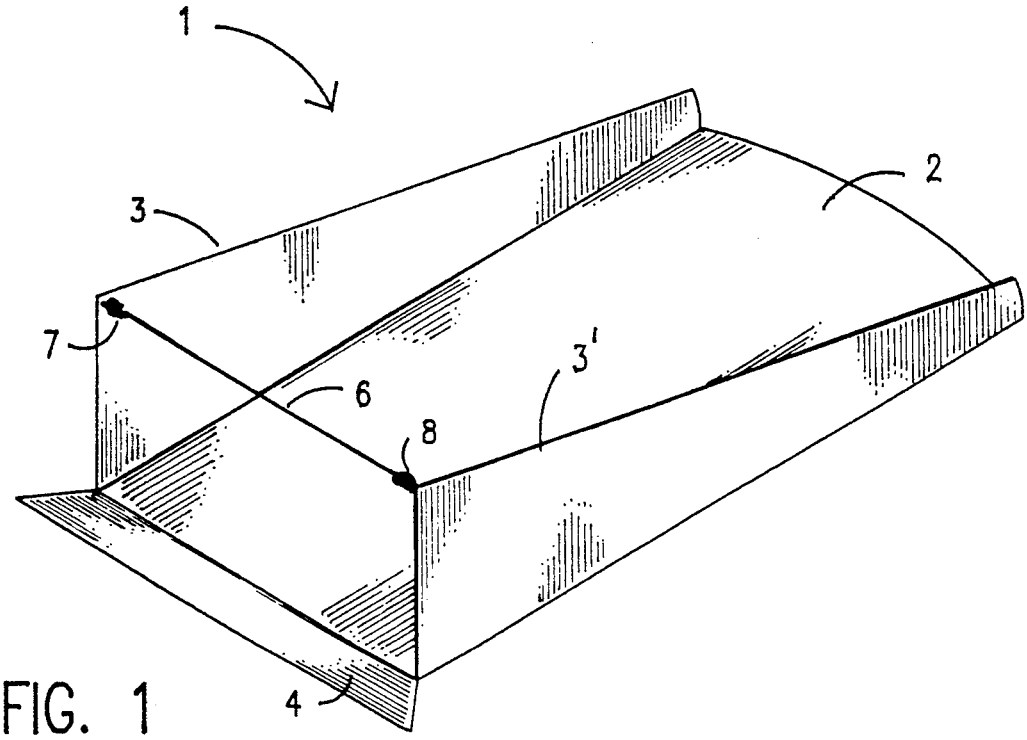
FIG. 1 is a perspective view of one modification of the trash bag holding device of this invention.
Figure 2:
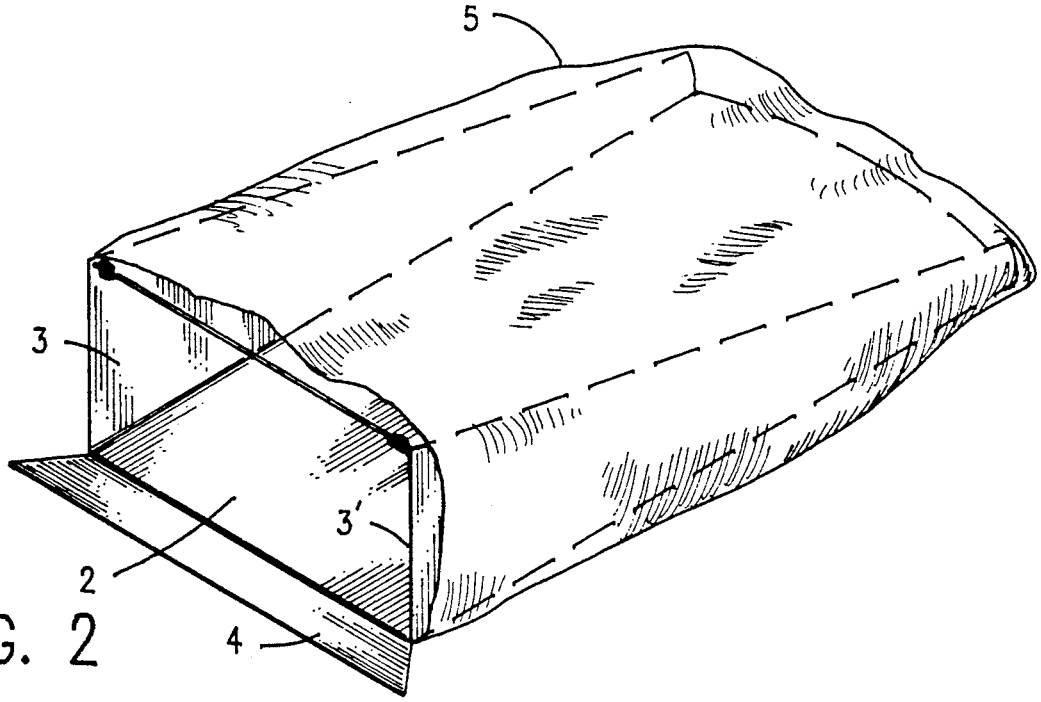
FIG. 2 is a similar view as in FIG. 1 with a trash bag imposed over the holding device.
Figure 3:
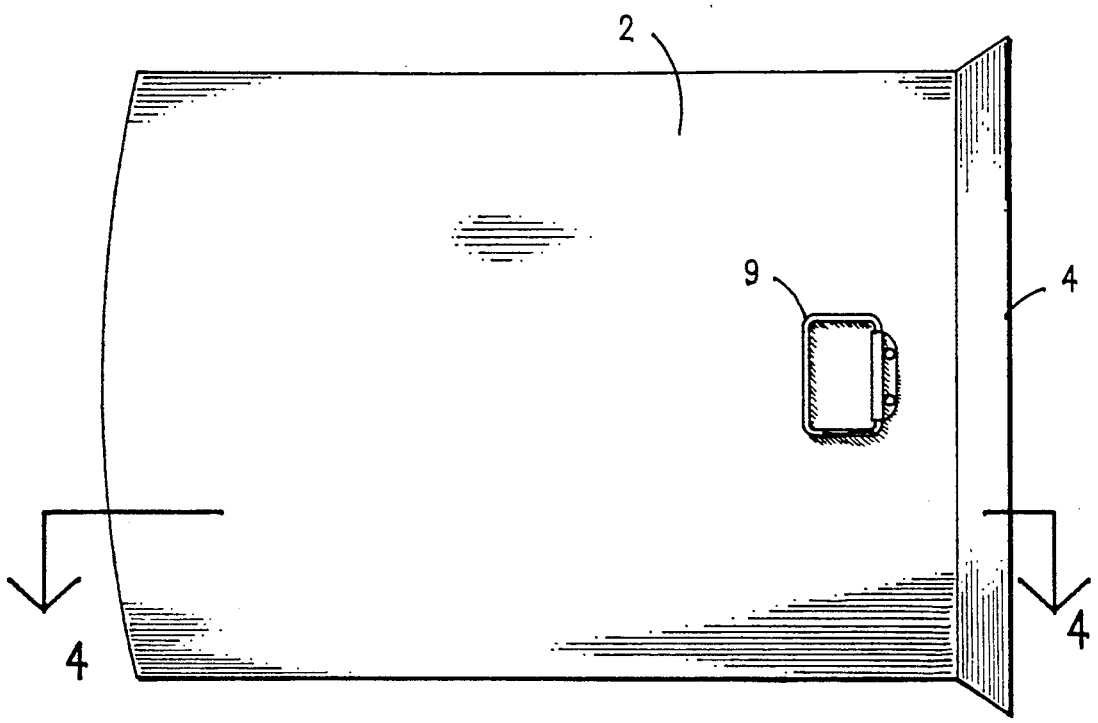
FIG. 3 is a bottom view of the modification of FIG. 1.
Figure 4:
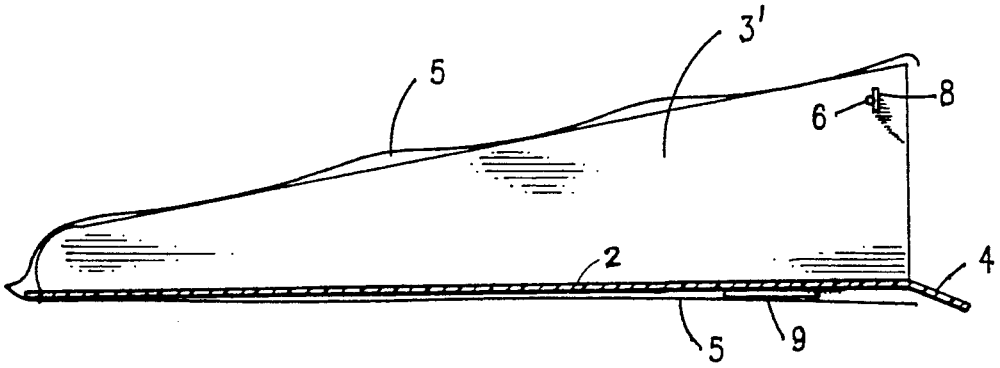
FIG. 4 is a side cross-sectional view of the bag and holder taken at line 4—4 of FIG. 2.

In FIGS. 1–4, the holding device 1 has bottom panel 2 and two side panels 3 and 3′ which are hinged to and foldable upon bottom panel 2. Lip 4 is an extension of bottom panel 2 which serves as a guide when sweeping leaves or other trash over panel 2 and into the interior of bag 5 which is shown in FIG. 2 to be extended over the side panels 3 and 3′ and bottom panel 2. Support arm 6 is a stiff wire which has a loop connection to side panel 3 and is hooked to loop 8 connected to side panel 3′, advantageously to hold the side panels each at an angle of approximately 90° with the bottom panel. When device 1 is not in use, the loop connection at 8 may be disconnected so side panels 3 and 3′ may be folded down on bottom panel for storage, or at an angle of approximately 0° with said bottom panel. Handle 9 is attached to the bottom of bottom panel 2 so that the device may be carried and hung thereby.

Figure 5:
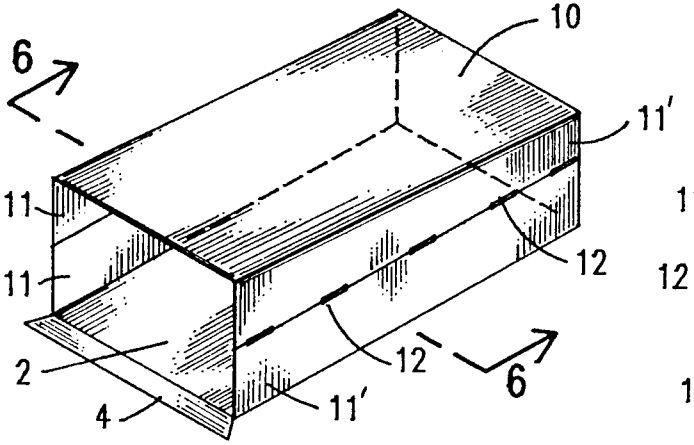
FIG. 5 is a perspective view of another modification of the bag holding device which has four sides when opened.
Figure 6:
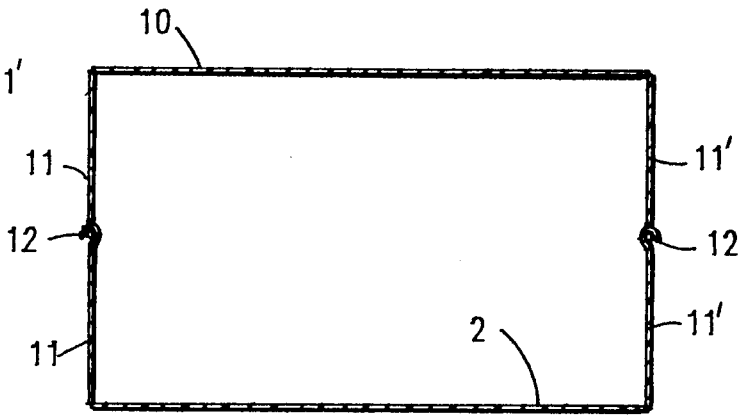
FIG. 6 is a cross-sectional end view taken at line 6—6 of FIG. 5.
Figure 7:
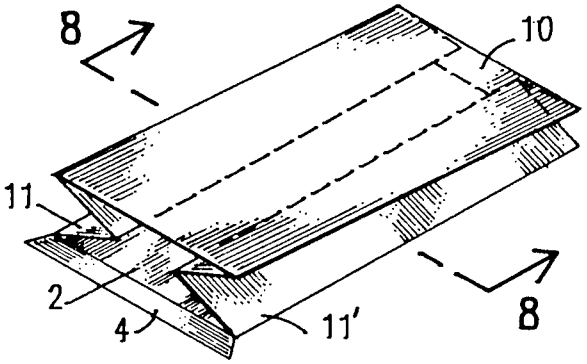
FIG. 7 is another perspective view of the modification of FIG. 5 with the sides only partially opened.

A four-side modification of this device is shown in FIGS. 5–8 with top side 10 added. The side panels 11 and 11′ are hinged and foldable by virtue of hinges 12 which join upper and lower sections of the side panels. The side panels are also each hinged to top panel 10 and top panel 2 so that folding of the side panels 11 and 11′ will produce a collapsed compact form for storage. FIG. 7 shows an intermediate stage in this folding operation.

Figure 8:
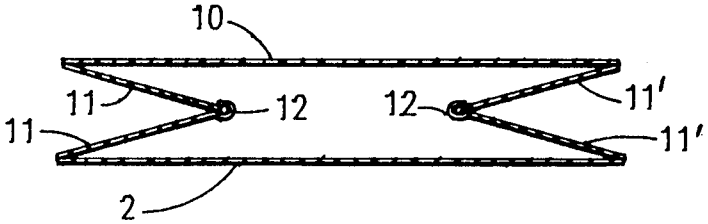
FIG. 8 is a cross-sectional end view taken at line 8—8 of FIG. 7.

FIG. 6 shows a cross-sectional end view taken at line 6—6 of FIG. 5, and FIG. 8 is a cross-sectional end view of the partially collapsed view of FIG. 7 taken at line 8—8.

In addition to the modifications shown in the drawings other modifications may be obvious from the disclosures of this invention. For example other modifications using a top panel are contemplated such as one having each side panel in one section (without hinges in the middle) and having the top panel hinges to only one of the side panels, so that the same side panel and the top panel can be collapsed to lay flat. In such case the other side panel would also collapse to lay flat above or below the bottom panel. When the holder is opened upon insertion in the bag, one or more hooks or catches are provided to secure the top panel to the top edge of other side panel and thereby to keep the holder open during the sweeping operation. This modification can be withdrawn from the bag when desired, the hooks or catches unfastened to release the connection between the top panel and this other side panel and thereby permit collapse of the holder.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. A trash bag holder adapted to hold the bag open while trash is swept thereinto comprising:

(a) a flat, thin bottom panel having two linear edges and having an appropriate size to fit into the interior of said bag, said bottom panel having a flap extending from one end thereof adapted to extend outside said bag when said holder is positioned inside said bag, and thereby to facilitate the sweeping of trash into said bag;

(b) first and second flat, thin side panels each also having a bottom linear edge and also adapted to fit into the interior of said bag, said side panels each also having a top linear edge;

(c) a first hinging means joining one of said linear edges of said bottom panel to said bottom linear edge of said first side panel;

(d) a second hinging means joining the other of said linear edges of said bottom panel to said bottom linear edge of said second side panel;

said side panels each being adapted to open to an angle of approximately 90° with said bottom panel and thereby hold said bag open when positioned inside said bag, and also adapted to be converted to a collapsed state by having said side flaps each turned to approximately 0° with said bottom panel; and (e) a restraining means capable of restraining said first and second side panels from collapsing onto said bottom panel when said holder is positioned in a supporting position inside said bag, in which said restraining means is a rod having connecting means at each end thereof, one of which connecting means is hingedly affixed to said top edge of one of said side panels and the other of said connecting means is capable of being temporarily affixed to said top edge of said other side panel.

2. A method for maintaining in an open and horizontal position an otherwise collapsible trash bag comprising the steps of inserting into the interior of said bag a holder in collapsed condition made of:

(a) a flat, thin bottom panel having two linear edges and having an appropriate size to fit into the interior of said bag, said bottom panel having a flap extending from one end thereof adapted to extend outside said bag when said holder is positioned inside said bag, and thereby to facilitate the entrance of trash into said bag;

(b) first and second flat, thin side panels each also having a bottom linear edge and also adapted to fit into the interior of said bag, said side panels each also having a top linear edge;

(c) a first hinging means joining one of said linear edges of said bottom panel to said linear edge of said first side panel;

(d) a second hinging means joining the other of said linear edges of said bottom panel to said linear edge of said second side panel;

said side panels each being adapted to open to an angle of approximately 90° with said bottom panel and thereby hold said bag open when positioned inside said bag, and also adapted to be converted to a collapsed state by having said side flaps each turned to approximately 0° with said bottom panel;

(e) a restraining means capable of restraining said first and second side panels from collapsing onto said bottom panel when said holder is positioned in a supporting position inside said bag;

after said holder in a collapsed condition is inserted into said bag, then adjusting said panels to angles of approximately 90° with said bottom panel;

affixing said restraining means to said side panels thereby to retain said side panels in 90° angles with said bottom panel;

positioning said bag on the ground with the bottom panel positioned flat on the ground;

sweeping refuse into said bag over said flap extending from said bottom panel; and when said bag is sufficiently filled with refuse, pulling said bag into an upright position and lifting said holder vertically out of said bag.

* * * * *